United States Patent [19]

Sumner

[11] 4,435,955

[45] Mar. 13, 1984

[54] METHOD AND APPARATUS FOR PRODUCING OPEN-END-SPUN NOVELTY YARNS

[75] Inventor: John H. Sumner, Greensboro, N.C.

[73] Assignee: Burlington Industries, Inc., Greensboro, N.C.

[21] Appl. No.: 414,576

[22] Filed: Sep. 3, 1982

Related U.S. Application Data

[63] Continuation-in-part of Ser. No. 127,446, Mar. 5, 1980, Pat. No. 4,361,007.

[51] Int. Cl.[3] ..... D01H 1/12; D01H 7/882; D01H 7/892; D02G 3/34

[52] U.S. Cl. ..... 57/409; 57/404; 57/408; 57/413

[58] Field of Search ..... 57/91, 209, 317, 400, 57/404, 408, 409, 413

[56] References Cited

U.S. PATENT DOCUMENTS

| | | | |
|---|---|---|---|
| 3,908,349 | 9/1975 | Urifu et al. | 57/414 |
| 3,956,876 | 5/1976 | Artzt et al. | 57/413 |
| 3,968,636 | 7/1976 | Junek et al. | 57/413 |
| 4,002,016 | 1/1977 | Fischer et al. | 57/409 X |
| 4,030,280 | 6/1977 | Folk et al. | 57/409 X |
| 4,109,454 | 8/1978 | Fehrer | 57/401 |
| 4,144,702 | 3/1979 | Pittman | 57/409 |
| 4,160,359 | 7/1979 | Frentress | 57/409 |
| 4,201,037 | 5/1980 | Artzt et al. | 57/411 X |

FOREIGN PATENT DOCUMENTS

| | | |
|---|---|---|
| 2138487 | 3/1973 | Fed. Rep. of Germany . |
| 2657096 | 6/1978 | Fed. Rep. of Germany . |
| 2808589 | 8/1979 | Fed. Rep. of Germany . |

*Primary Examiner*—Donald Watkins

*Attorney, Agent, or Firm*—Cushman, Darby & Cushman

[57] ABSTRACT

A method and apparatus for open-end spinning of novelty yarn produces novelty yarns in a simple manner. A sliver is fed to the fiber separating device of an open-end spinning apparatus to form distinct fibers, the fibers are air transported in a fiber flow path to the twisting device, controlled formation of effects (particularly slubs) is effected during air transport of the distinct fibers in their path, the formed effects are intermittently passed to the twisting device (e.g. pseudo-randomly), the fibers fed to the twisting device are twisted into a continuous strand of effect yarn (particularly slub yarn), and the continuous strand of effect yarn is taken up. The controlled formation of effects may be accomplished in a number of manners: introducing a needle making an angle of 25°–45° with respect to the direction of fiber flow into the fiber flow path in the transport section; pivoting an elongated member about an axis perpendicular to the direction of fiber flow so that a free end thereof engages, or substantially engages, a wall of the transport section to collect fibers; or by pivoting an elongated member about an axis skew with respect to the direction of fiber flow, into contact, or substantial contact, with a wall of the transport section.

15 Claims, 22 Drawing Figures

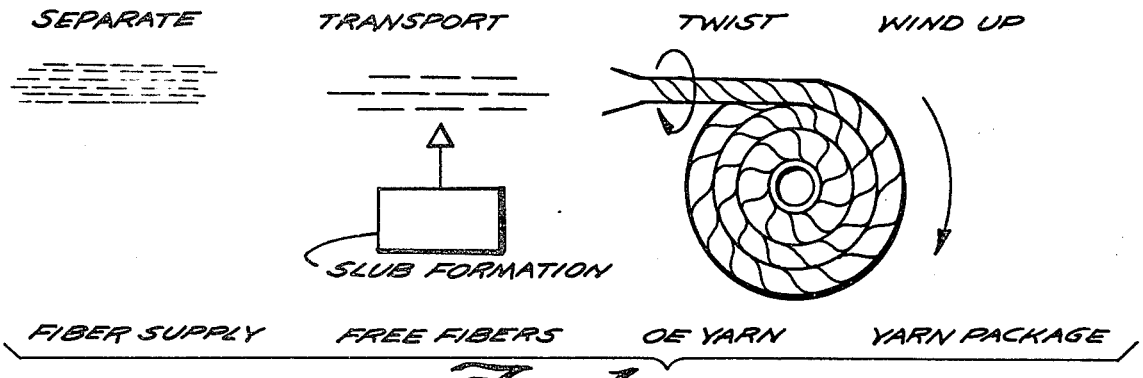
Fig. 1
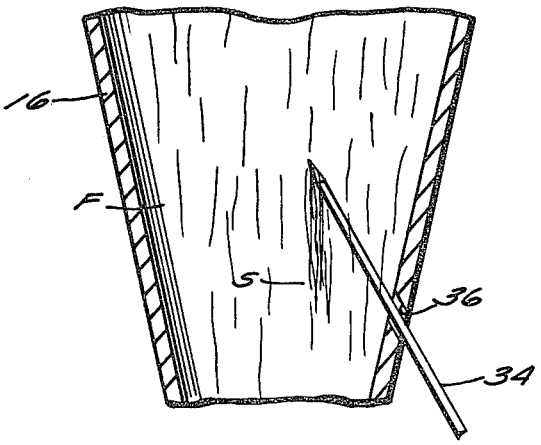
Fig. 3
Fig. 1a
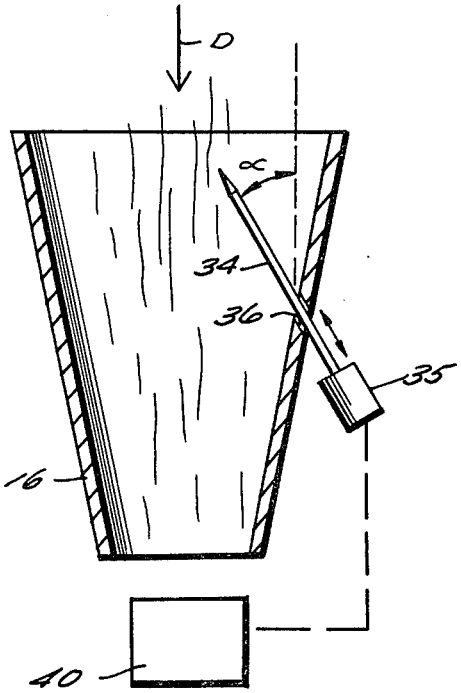

Fig. 4b
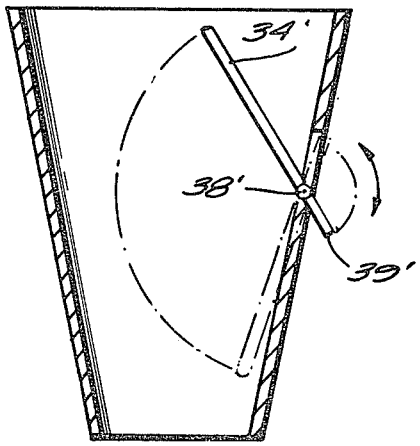
Fig. 4c
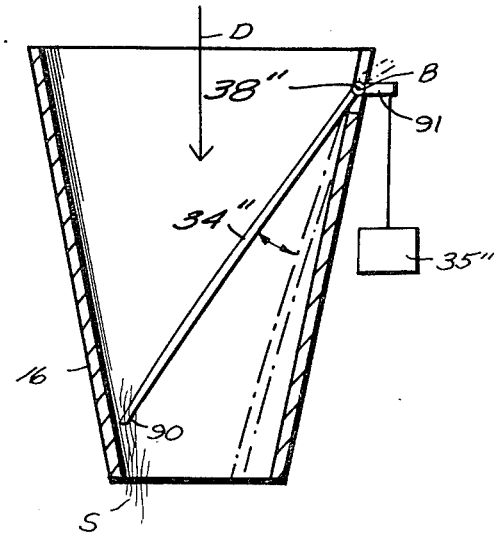
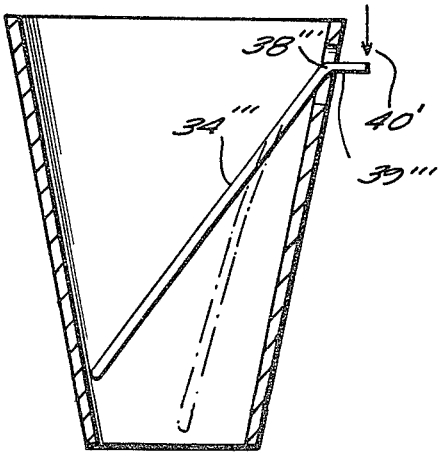
Fig. 4d
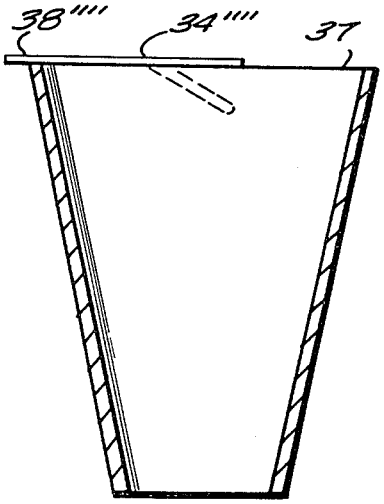
Fig. 4e

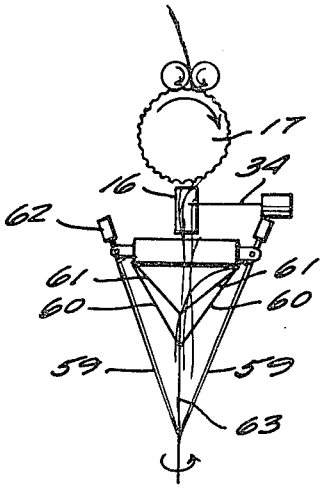
Fig. 9
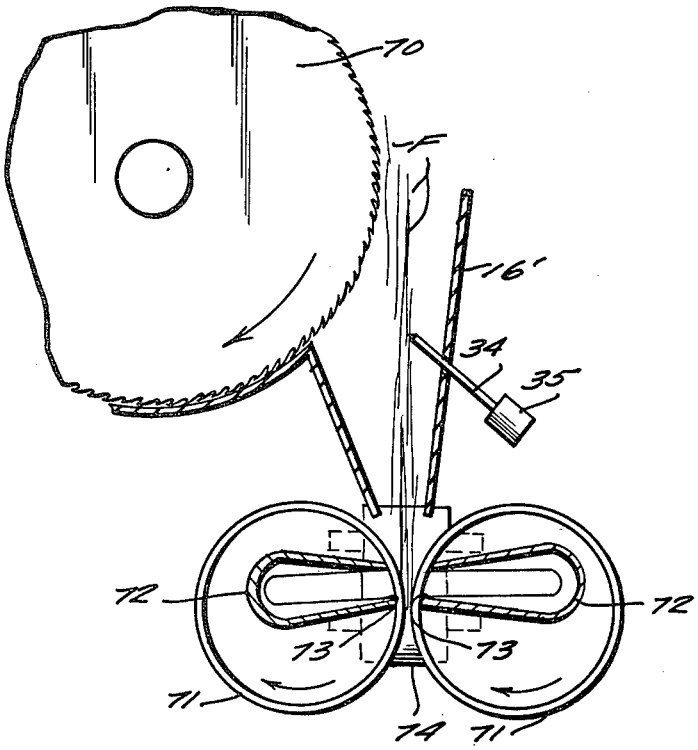
Fig. 10
Fig. 11
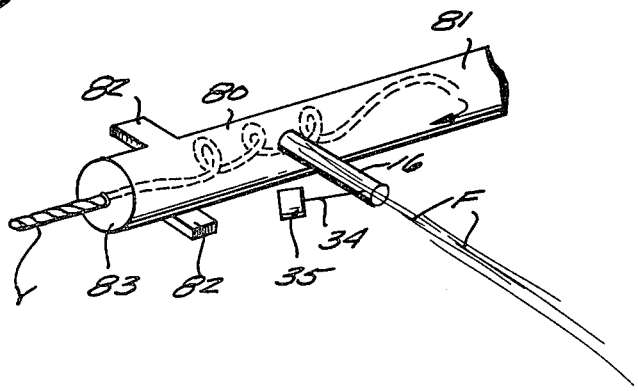

METHOD AND APPARATUS FOR PRODUCING OPEN-END-SPUN NOVELTY YARNS

CROSS REFERENCE TO RELATED APPLICATION

This application is a continuation-in-part of my application Ser. No. 127,446 filed Mar. 5, 1980, now U.S. Pat. No. 4,361,007.

BACKGROUND AND SUMMARY OF THE INVENTION

Open-end spinning of yarn is becoming increasingly commercially popular because of a number of inherent advantages of open-end spinning over conventional ring spinning. Some of the advantages of open-end spinning over ring spinning are: yarn formation and winding are not interdependent, allowing for removal of full packages while the machine is running; package size is theoretically unlimited; power consumption increases little with package weight; and package shape is suitable for most of the succeeding operations so that rewinding is eliminated. Additional advantages are the appearance, processability, and economy of the open-end yarns, and generally improved performance of end-products made with open-end yarns.

While it is desirable to be able to produce open-end novelty yarns (particularly open-end slub yarns), there have been a large number of practical problems associated with conventional techniques and proposals for making open-end novelty yarns. As a result, most novelty (particulary slub) yarns now produced are ring spun. Present conventional and proposed methods for formation of slubbed open-end yarns include applying the slubs to the sliver before it is fed to the spinner; rapidly increasing or decreasing the feeding rate of the sliver; varying the withdrawal speed of the yarn from the spinner (U.S. Pat. 4,144,730); introducing and withdrawing a plurality of needle free ends into the fiber flow pivotal about an axis skew to the fiber flow to cause collection and release (German OFF. No. 26 57 096); and forming the slubs exteriorly of the open-end spinning operation and then adding the slubs in a separate path to a point just before the yarn spinning device.

According to the method and apparatus of the present invention it is possible to produce novelty yarns (particularly slub yarns) having most of the desirable features of conventional ringspun slub yarns. The method is subject to wide applicability and ready control to produce a wide variety of different novelty effects, and the apparatus according to the present invention is basically simple and is believed to be adaptable for use on almost any type of conventional open-end spinning equipment, and in fact can be retrofit onto most conventional open-end spinning equipment.

The invention is useful for making a wide variety of novelty yarns, which in general includes any yarn having unusual or special effects such as nubs, neps, lumps, slubs, or the like. However, the invention is primarily suitable to the production of slub yarns. Slub yarns are a particular species of novelty yarn with soft, thick, unevenly twisted lengths which alternate with essentially normalsized places in the yarn. Slub yarns provide a very definite and readily discernible texture effect in the products into which they are made, the degree of course being dependent upon the frequency and size of the slubs, providing well defined, relatively large surface manifestations in the products produced with the yarn.

According to one aspect of the present invention, open-end spinning of a novelty yarn utilizing an open-end spinning apparatus having a fiber separating device, a twisting device, an elongated thin member, and a fiber transport section interconnecting the separating and twisting devices, is provided by: Effecting controlled formation of effects in the fiber transport section by effecting controlled introduction of the elongated member into the fiber flow within the transport section so that it makes an angle of less than about 45° (about 25°–45°) with respect to the direction of fiber flow; and intermittently passing those effects to the twisting device. Pseudo-random control means are provided for pseudo-randomly controlling insertion and withdrawal of the elongated member into the fiber flow. A twisting device twists the fibers fed thereto, including any effects passed thereto, into a continuous strand of novelty yarn, and the novelty yarn continuous strand is taken up.

According to another aspect of the present invention apparatus for spinning novelty yarn includes means for effecting controlled formation of effects in the transport section of an open-end spinning device, and for occasionally passing the formed effects to a twisting device. The means for effecting controlled formation include: An elongated member having a length long enough to extend from one side of the tubular wall of the fiber transport section to another portion of the tubular member wall. Means for pivotally mounting, for pivotal movement about an axis, the elongated member at a first side of the tubular member wall so that the elongated member has a free end extending angularly from the first side of the tubular member wall generally in the predetermined direction of fiber flow, and so that it is moveable from a collecting position wherein the free end thereof engages, or substantially engages, another side of the tubular member wall to collect effects between the free end and the wall, to a release position wherein the free end is spaced from the tubular member wall. The mounting means may be a pendulum type mounting means, i.e. the axis of pivotal movement is perpendicular to the predetermined direction of fiber flow, and means for oscillating the elongated member about its axis of pivotal movement may provide movement from a first collecting position in engagement, or substantial engagement, with one portion of the tubular member wall, through a release position, to a second collecting position in engagement, or substantial engagement, with another portion of the tubular member wall. Alternatively the axis of rotation and the predetermined direction of fiber flow may be skew. The elongated member may be curved outwardly from the first side of the tubular member wall, or may be straight.

It is the primary object of the present invention to provide a simple and practical method and apparatus for producing open-end novelty (and particularly slub) yarns. This and other objects of the invention will become clear from an inspection of the detailed description of the invention and from the appended claims.

BRIEF DESCRIPTION OF THE DRAWINGS

FIG. 1 is a diagram illustrating the principle of open-end spinning, including a schematic representation of a modication thereof to produce novelty yarns according to the present invention;

FIG. 3 is a detailed sectional view illustrating fiber collection on a physical structure inserted in the fiber stream of the apparatus in FIG. 2;

FIGS. 4*a*–4*e* are detailed cross-sectional schematic views illustrating various forms the introduced physical structure, the forms 4*a* and 4*c* being encompassed by the present invention;

FIGS. 8, 9, 10, and 11 are schematic showings of other common open-end spinning machines modified to employ exemplary apparatus for forming novelty yarn;

DETAILED DESCRIPTION OF THE DRAWINGS

FIG. 1 shows an entirely diagrammatic representation of open-end spinning, illustrating the basic principles thereof. FIG. 1 indicates that in the first stage of the open-end spinning process the fibers are separated (from a source, such as a sliver) to provide a fiber supply. Next the individual separated fibers are transported as free fibers, primarily in a fiber transport section. The free fibers are then twisted to form the open-end yarn, and the yarn package is taken up. According to the present invention, the basic open-end spinning technique illustrated diagrammatically in FIG. 1 is modified so that novelty yarns in general, and slub yarns in particular, are produced . This is accomplished in general by forming effects from the free fibers during transport of the fibers from the separating to the twisting stages, and occasionally (preferably pseudo-randomly) allowing the effect fibers to pass to the twisting stage to be formed with the rest of the fibers flowing therewith into a slub yarn.

Figure 2:
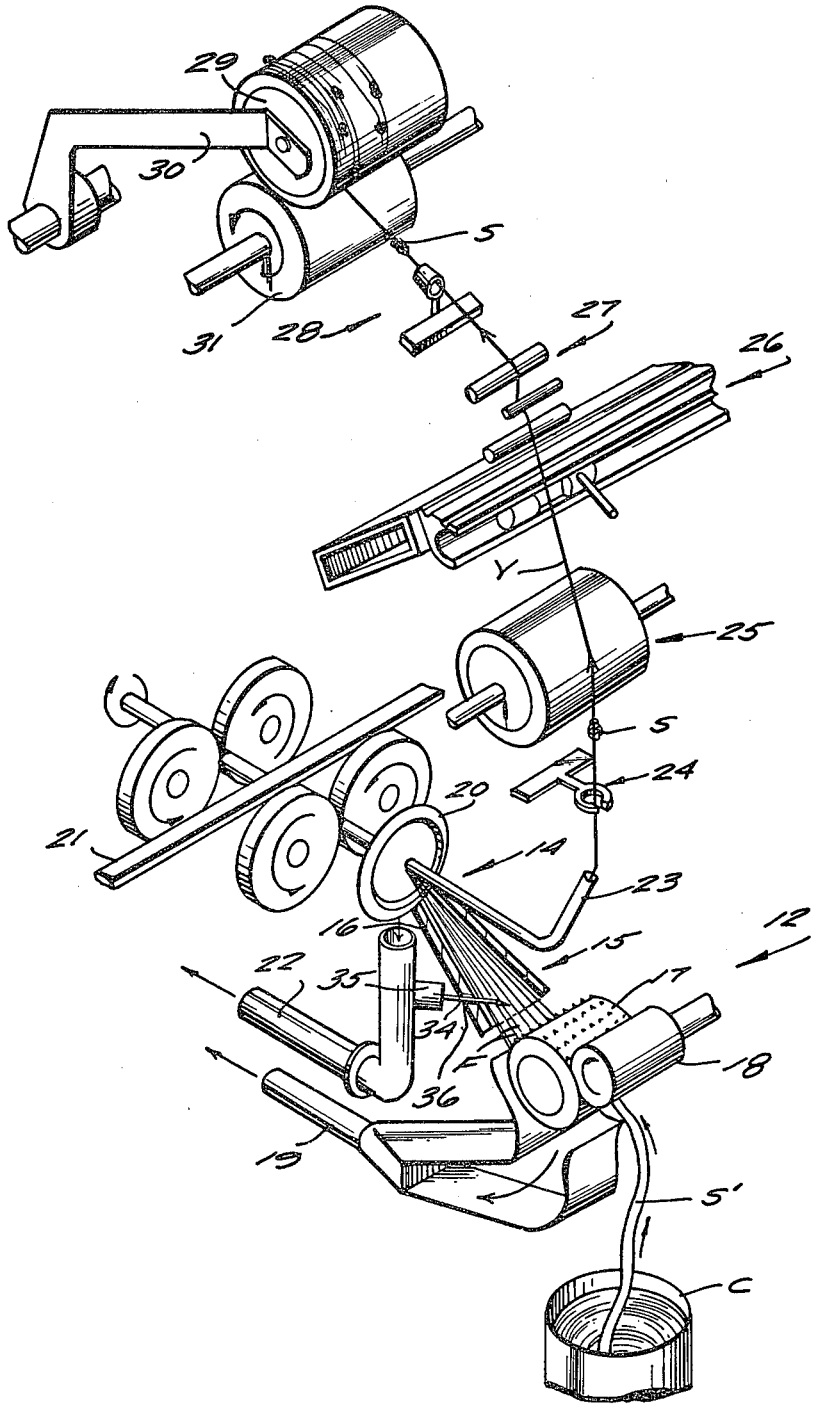
FIG. 2 is a diagrammatic exploded view illustrating all of the component parts of an exemplary open-end spinning machine according to the present invention.

An exemplary apparatus for producing novelty yarn is illustrated schematically in FIG. 2. The structure illustrated therein comprises a conventional open-end spinning machine of the rotor type which has been modified to produce novelty yarn, the machine specifically illustrated being a modified SPIN-FLEX rotor spinning machine manufactured by Barber-Colman Company of Rockford, Ill.

The apparatus of FIG. 2 includes a fiber separating device, illustrated generally at 12, and a fiber twisting device, illustrated generally at 14. A fiber transport section 15, defined by a conventional fiber transport tube 16 having a decreasing diameter conical cross-section, is disposed between the separating 12 and twisting 14 devices.

In the FIG. 2 device, the separating device 12 comprises a conventional opening roll 17 which cooperates with a feed roll 18, and provides for the feeding of a sliver S′ from a can C. The opening roll 17 separates the sliver S′ into the individual fibers F, these being passed to the fiber transport section 15 while suction is provided by suction tube 19 for trash removal. The twisting device 14 illustrated in FIG. 2 comprises a rotor 20 which is powered by a conventional rotor belt 21, with suction for the rotor chamber being provided by the suction tube 22. Yarn produced by rotor 20 passes through yarn outlet tube 23 through a lower traverse 24 to a withdrawal roll 25. The yarn Y so formed then may pass past the "third hand" 26, compensator 27, and upper traverse 28 to the package 29 mounted on package arm 30. Take-up roll 31 cooperates with the package 29 to ensure proper take-up of the yarn Y.

All components described heretofore in FIG. 2 are conventional. Further, the apparatus of FIG. 2 is modified to simply and efficiently produce novelty yarns, particularly slub yarns. Means are provided for effecting controlled formation of effects in the fiber transport section 15 and for intermittently passing the formed effects to the twisting device 14. The form that such means takes in FIG. 2 is a physical structure—that is the elongated needle 34—that is operatively connected to the solenoid 35 which comprises a means for moving the needle 34 into and out of the fiber transport section 15 through an opening 36 formed in the fiber transport tube 16. When the needle 34 is in the fiber flow in fiber transport section 15, fibers F collect along the length of the needle to form an effect—such as a slub S (see FIG. 3). When the needle 34 is withdrawn from the tube 16 by the solenoid 35, the slub S is released, then being passed to the twisting device 14, resulting in the yarn Y being a novelty yarn having effects (preferably slubs) S formed at different points along the length thereof.

In the embodiment illustrated in FIG. 4*a*, the needle 34 is moved in and out by the means 35 so that it makes an angle with respect to the path of fiber flow. The objective of the needle is to serve as an intermittent obstacle in the path of the fibers, along the length of which obstacle a portion of the fibers drape themselves. These provide a slub when the needle is withdrawn and the accumulated fibers are released, to be carried with the main stream of fibers into the twisting device 14. The angle $\alpha$ is less than 45°, and preferably about 25–45°. This is optimum for fiber-entrapping capacity while still allowing fibers to slide off when the needle is withdrawn.

The needle may take the form of a conventional needle, but it may also be a pie-like wedge, a narrow ribbon-like strip, or the like. The term "needle" as used herein is used in a generic sense to indicate any of these structures. The needle is preferably small in cross-section; i.e., of itself it offers only a thin obstacle across the path of the fiber flow. Conveniently the needle may be pointed in the conventional manner of needles, but it may equally well be flat- or round-ended. The needle is most commonly straight, but given more sophisiticated thrusting apparatus, it may also be curved upward or downward into the fiber stream. The path of the thrust of the needle into fiber transport tube 16 is preferably across one-third to three-fourths of its inside diameter, though shorter or longer thrusts may be employed if desired. It is apparent that compared to an $\alpha$ of 90°, the actual length of thrust of the needle through the wall of the transport tube will be greater, for a given percentage crossing of the tube diameter, the nearer $\alpha$ approaches 25°.

It is highly desirable, whatever the value of $\alpha$, that the inward thrust of needle 34 not carry its point beyond the intake edge 37 of fiber transport tube 16 (also shown in FIG. *7b* as the hookup junction line 37 of fiber transport section 15 and fiber separating device 12). In practice fiber transport section 15 is commonly brought into and out of conjunction with separating device 12 by hinged means (not shown); and if the needle of the invention is permitted to overlap the junction line, there exists unnecessary risk of the needle being damaged if it is ever left unretracted when the fiber transport section is swung out.

Space limitation problems associated with fitting the needle(s) and drive means 35 to actual open-end spinning machines, where space tolerances are very restrictive, generally complicate the use of very low or very high values of $\alpha$. The special attraction of about a 25°–45° value of $\alpha$, as will be evident from consideration of FIG. *4a*, is that it offers the possibility of making more dense and compact slubs as the result of the accumulated fibers sliding down the needle and packing into the point of the angle between needle and wall. The amount of accumulation of slub fibers varies directing with the size of $\alpha$, the thrust of the needle, and the time the needle remains in the fiber transport tube.

In the structure shown in FIG. *4b*, the in-and out motion of the needle 34 is replaced by the rotary motion of needle or elongated member 34', pivotally mounted to fiber transport tube 16 at 38', and having a portion thereof 39' operatively connected to a solenoid 35' or like power means. The release of the accumulated slub fibers is effected by dropping the needle to its downward position as depicted. In this position the slub is stripped from the needle by the air and fibers flowing through the transport tube.

In the embodiment of the invention shown in FIG. *4c*, needle 34'' free end 90 pivots through a relatively short arc from pivot 38'' under the up and down action of solenoid 35'' acting on short arm 91. The free end 90 of the needle optimally lightly contacts a portion of the transport tube wall opposite the pivotal mounting menus 34'', although it has been found that a gap of about 1 mm (i.e. "substantial engagement") is permissible because the fibers sliding down the inclined needle tend to fill and bridge the gap almost instantly when the needle end moves close to the wall. The collected slub fibers, shown schematically at S in FIG. *4c*, slip off into the fiber stream when the needle free end 90 is moved away from the wall, as indicated by the dotted lines in FIG. *4c*. In this embodiment the axis of pivotal movement B (perpendicular to the page in FIG. *4c*) and the direction of fiber flow D are skew.

The introduction and withdrawal of the needle or elongated body members of FIGS. *4a*, *4b*, and *4c* into and out of the fiber stream may in theory be done manually, but in actual practice an automatic control mechanism is highly desirable. If desired a paterned, regular schedule of control impulses may be supplied by the controller to yield a consistent pattern of slubs in the product yarn. In most instances, however, in order to prevent undesired patterning in fabrics made from the yarn, control of the introduction and withdrawal of the needle or elongated body member, or members, within fiber transport tube 16 preferably is pseudo-random. Such a pseudo-random control is preferably accomplished by utilizing a suitable randomizer 40 (see FIG. *4a*), operatively connected to the control solenoids (e.g. 35', 35''). Preferably, the randomizer is a Pugh randomizer, such as shown in U.S. Pat. No. 3,748,648, the disclosure of which is hereby incorporated by reference herein.

Figure 15:
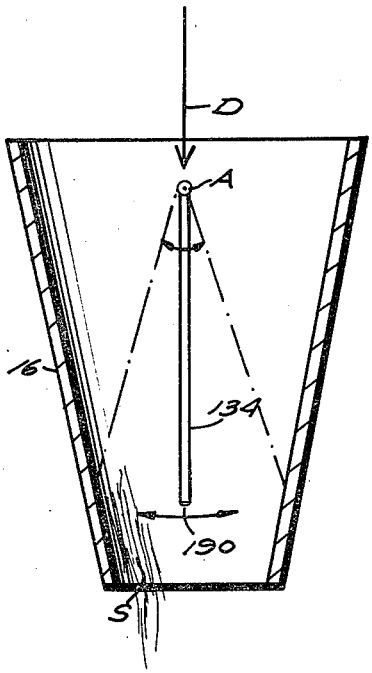
FIG. 15 is a front cross-sectional view of the structure of FIG. 14 showing the structure in a release position in solid line, and in first and second collecting positions in dotted line, with fiber collection being illustrated schematically in the first (left-side) collecting position.
Figure 14:
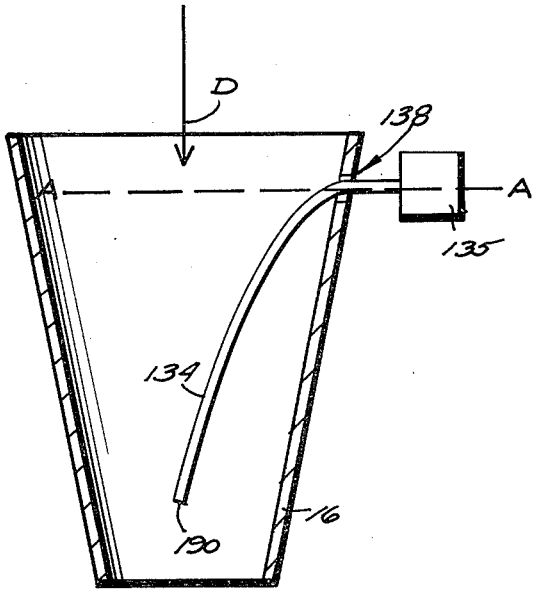
FIG. 14 is a side cross-sectional view of another form the introduced physical structure according to the present invention may take.

FIGS. 14 and 15 illustrate another modification of means for effecting controlled formation of effects according to the present invention. Numerals in FIGS. 14 through 16 correspond to like numerals in FIGS. *4a*–*4c* except they are preceded by a "1" or "2".

The embodiment illustrated in FIGS. 14 and 15 comprises an elongated member 134 mounted like a pendulum. The member 134 is relatively rigid, and has a length long enough to extend from one side of the tubular member wall 16 to another portion thereof. Means 138 are provided for pivotally mounting, for pivotal movement about an axis A—A, the member 134 at a first side of the tubular member wall 16 so that the elongated member has a free end 190 extending angularly from the first side of the tubular member wall 16 generally in the predetermined direction of fiber flow D. The member 134 also is mounted so that free end 190 thereof is moveable from a first collecting position (left-hand dotted line designation in FIG. 15) in engagement, or substantial engagement (as discussed above with respect to FIG. *4c*) with one portion of the tubular member wall whereby a slub S is formed, through a central release position (illustrated in solid line in FIG. 15) to a second collecting position (illustrated in dotted line on the right of FIG. 15) in engagement, or substantial engagement, with another portion of the tubular wall member. The mounting means 138 may simply comprise a sleeve in the tubular member wall 16 receiving a shaft portion 93 of the elongated member 134. Means 135 are provided for oscillating the elongated member 134 between its collecting positions, the oscillating means 135 being connected to the shaft portion 93, and comprising any conventional oscillating structure.

Figure 16:
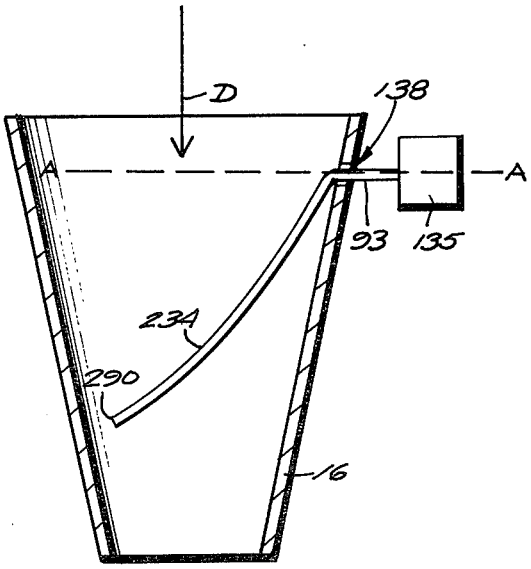
FIG. 16 is a side cross-sectional view of a structure similar to that of FIG. 14 except that the elongated member has a different shape.

In FIG. 16 another minor modification of the pendulum effect-forming means is illustrated. The only difference between the embodiment of FIG. 16 and that of FIGS. 14 and 15 is that the elongated member 234 has a different shape within the tube 16 than the elongated 134. As illustrated in FIG. 16, the elongated member 234 is curved outwardly from the first side of the tubular member wall (where shaft 93 is received). In the FIG. *4c* embodiment the elongated member 34'' may also have an outward curvature of the type illustrated in FIG. 16.

While the externally controlled embodiments of FIGS. *4a*, *4c*, and 14–16 are preferred, selfcontrolled means for collecting and releasing the slubs within the fiber transport tube are also surprisingly effective. One such embodiment, closely related in appearance to that of FIG. *4c*, is shown in FIG. *4d*. Here enlongated member 34''' comprises a length of piano wire, thin spring steel, or similar moderately stiff but nonetheless flexible metal or plastic strip material. The upper end of member 34''' may be fixed at point 38''' such that its lower end exerts a spring-like constant light pressure against the opposite wall of the fiber transport tube. Preferably, potential for precisely adjusting the tension of the elongated member against the tube wall is provided by screw or other variably adjustable means 40' acting against the extension 39'''. The slub fiber accumulates in the angle between the elongated member and the lower tube wall. The mass of the slub and the pressure of the fiber and air stream against it gradually bend member 34''' inward sufficiently to permit the slub to slip out at intervals through the resulting gap, as represented by the dotted line. This means of collecting and releasing slub material is very simple to set up and operate, but it lacks the potential for continuously varying the slub size and spacing which an electronic control mechanism provides in the other embodiments.

Another self-controlled collection and release means is shown in FIG. 4*e*. In this embodiment needle 34'''' comprises a length of piano wire, thin spring steel, polyethylene terephthalate film, or the like flexible material, taped or clamped to junction surface 37 of fiber transport tube 16 at point 38'''' so that it sticks out into the stream of fibers. Point 38'''' may equally well constitute a hole lower down on the tube wall, with member 34'''' thrust through it. A typical example of this embodiment is a narrow wedge of 10-mil polyethylene terephthalate film, taped on junction surface 37 between separating device 12 and fiber transport section 15 of the Platt Saco Lowell 883 Rotospin unit so that the tip of a triangle with a 2-mm base projects 6 mm across the fiber stream entering transport tube 16. Fiber collects on the triangle until it bends sufficiently, as shown by dotted lines, for the aggregated fibers to slip off the needle and proceed to the twisting device 14. The plastic needle meanwhile returns to its starting position and the collection of fibers repeats itself.

While the physical structures for providing fiber collection to form effects in the fiber transport section 15 have been described as needles, there are other geometric configurations that also are suitable for providing effect formation. In general, any geometric configuration that allows fiber collection without unnecessarily restricting the general flow of fibers in the fiber transport section is suitable. Such a member is inserted in the fiber transport section 15 in such a position that it does not act upon substantially all the fibers in the fiber low, provides no holding back force on the yarn being formed, and does not effect substantial reorientation of the majority of fibers in the fiber flow.

Figure 5:
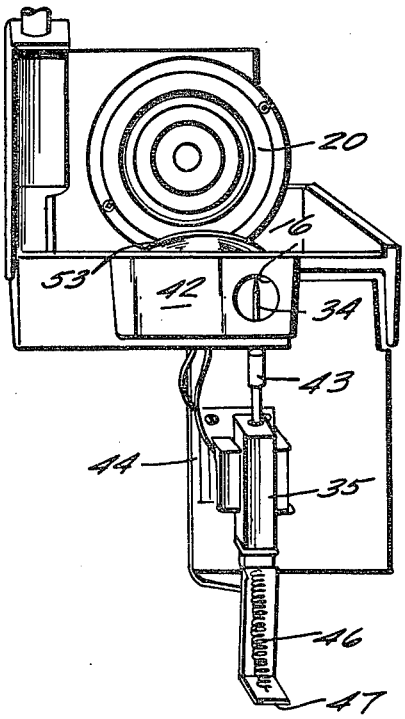
FIG. 5 is a perspective view, with rotor cover pivoted to a rotor-exposing position, illustrating one embodiment of exemplary apparatus for practicing novelty yarn formation.
Figure 6A:
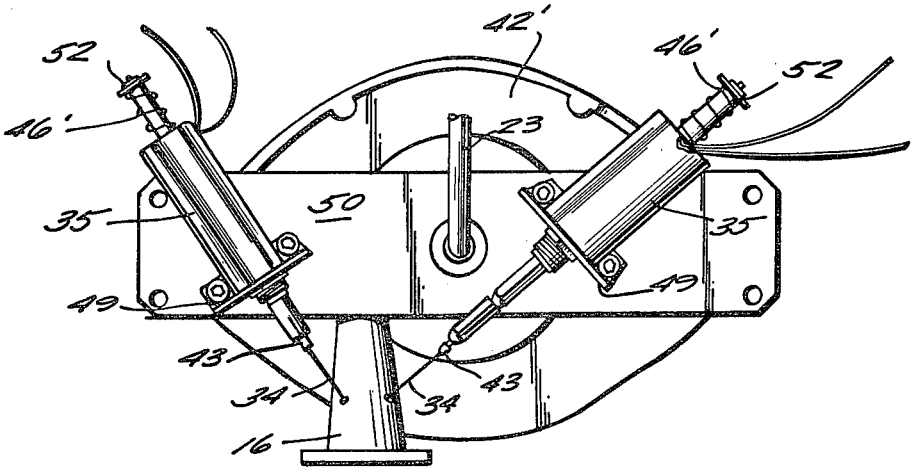
FIG. 6*a* is an exposed front plan view of the fiber transport tube and rotor cover plate of an open-end spinning machine illustrating another apparatus for practicing novelty yarn formation.
Figure 6B:
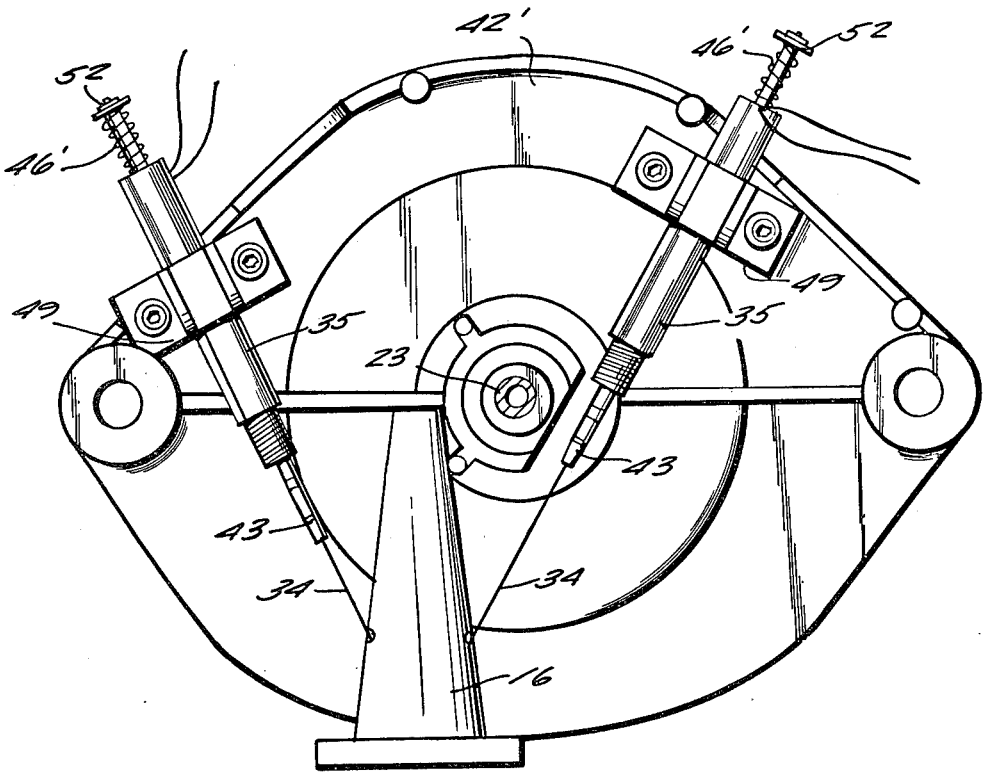
FIG. 6*b* is a view similar to FIG. 6*z* for yet another slightly different embodiment.
Figure 7A:
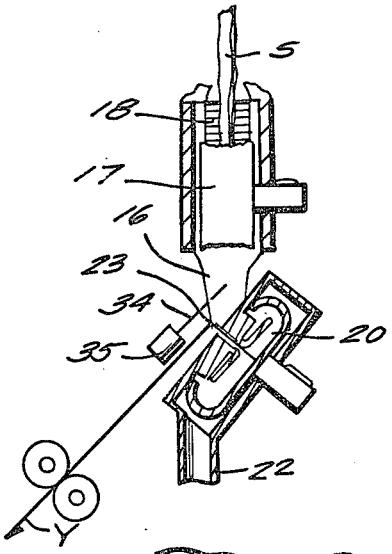
FIG. 7*a* is a side cross-sectional schematic view of one conventional open-end spinning machine modified to practice novelty yarn formation.
Figure 7B:
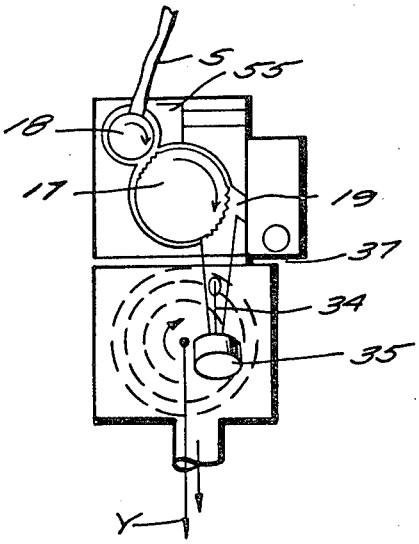
FIG. 7*b* is a front plan view of the device of FIG. 7*a;*

Forms of physical structures for creating effects, in conjunction with conventional open-end spinning machines, are illustrated in FIGS. 5, 6*a* and 6*b*. In FIG. 5, a single needle 34 is operatively connected to a solenoid 35 for movement into and out of the fiber transport tube 16 of a Platt Saco Lowell 883 Rotospin unit, the transport tube 16 of this unit being molded into a cover plate 42 for the rotor 20, the cover plate 42 being mounted for pivotal movement from the open position illustrated in FIG. 5, to the closed, operating position. In a typical application of the invention the needle is mounted perpendicular to the axis of the transport tube at a point 6 mm below its entrance, and thrusts 6 mm into the tube. The solenoid 35 preferably is a push type solenoid, and the linearly moveable element thereof is directly connected to a chuck 43 to which the needle 34 is removeably attached. A stationary mounting plate 44 connects the solenoid 35 to the cover plate 42, and a return spring 46 acts between the moveable element of the solenoid 35 and a bracket 47 stationarily mounted to the mounting plate 44.

In FIGS. 6*a* and 6*b*, two needles 34 are shown operatively associated with the fiber transport tube 16 of an Ingolstadt RU-11 open-end spinning machine unit viewed from the front and with the mounting cover removed. Again chucks 432 are provided directly connected to the solenoid 35 moveable elements. In FIG. 6*a*, the solenoids are mounted on stationary angles 49 to the centering plate 50 through which the yarn outlet tube 23 of the machine extends. The component 42' is the cover plate and transport channel for the machine. Return of the needles 34 to a position wherein they are withdrawn from the tube 16 is provided by return springs 46' acting between the cap 52 of the moveable element of the solenoids, and the stationary outer casing of each solenoid 35. The needles 34 enter the transport tube 16 at angles $\alpha$, as defined in FIG. 4*a*, of about 40° and 45° respectfully, and as depicted they do not, and/or need not, lie in the same plane with each other.

In another form on the Ingolstadt machine, as generally illustrated in FIG. 6*b*, the two solenoids lie behind centering plate 50, i.e., between the centering plate and cover plate 42'. They are mounted directly on cover plate 42' in such a way that both lie in the same plane, with their needles 34 entering opposing sides of transport tube 16 at angles of about 25° and 30°, respectively. In this particular embodiment it is desirable that the thrusts of the needles be short enough that the needle tips cannot clash inside the transport tube.

In FIGS. 6*a* and 6*b*, as well as in other forms employing two or more needles, the randomizer 40 is operated to control the solenoids so that each needle 34 is inserted into the transport tube 16 on a pseudo-random basis with one needle preferably being slightly delayed a varying amount of time relative to the introduction of the other needle. The FIGS. 6*a* and 6*b* forms are eminently suited for producing slub yarns having most of the desirable attributes of conventional ring spun slub yarns, and suitable for use for the production of drapery, upholstery, suiting, and other fabrics.

Figure 12:
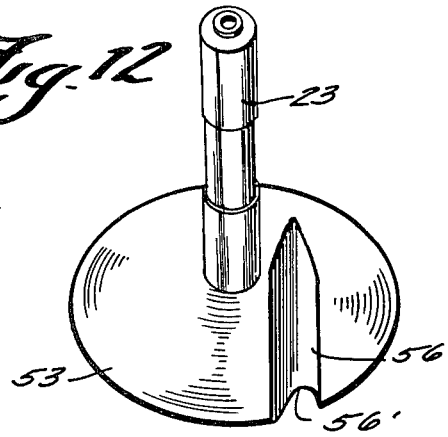
FIG. 12 is a botton perspective view of a modified separator plate utilized in the FIG. 5 unit.
Figure 13:
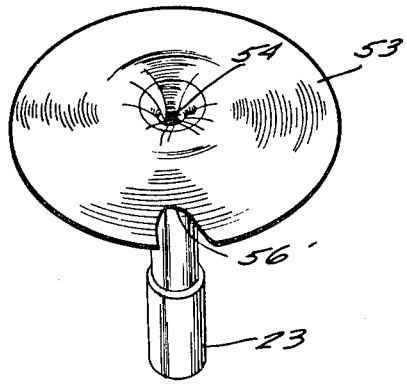
FIG. 13 is an upper perspective view of the plate of FIG. 12.

The Platt Saco Lowell 883 Rotospin unit depicted in FIG. 5 includes a slightly modified conventional circular separator plate 53 attached to the back of cover plate 42, the center of which separator plate constitutes a conventional navel 54 which in turn comprises the entry to yarn outlet tube 23. The separator plate 53, navel 54 and outlet tube 23 jointly comprise a single mushroom-shaped machine component, illustrated in FIGS. 12 and 13. The peripheral separator plate portion of this component serves conventionally to assure that the flow of fibers from fiber transport tube 16 to rotor 20 is direct and complete, as is well known in the art. The fiber flows across the back of the separator plate into the rotor.

To assure the smooth flowing of the mixture of fibers and slubs coming from the exit of fiber transport tube 16, a bullet-shaped groove 56 (see FIG. 12) about 30 mm long is cut across the conventionally contoured back surface of the Platt separator plate 53. This groove, 7 mm wide and having a maximum depth of about 3 mm, lies in line with the flow path of the fibers coming from the fiber transport tube, and terminates as a curved notch 56' in the opposite periphery of the plate. On the Platt 883 machine, in the absence of the groove, the slubs released in the fiber transport tube may tend to bounce off the back of the separator plate 53 and be drawn into the vacuum port beneath the rotor. The notch 56' terminating the groove 56, when viewed from the upper or navel side of the separator plate (FIG. 13), lies at about the one o'clock position on the plate 53 as illustrated in FIG. 5.

FIGS. *7a, 7b,* 8, 9, 10, and 11 show a variety of conventional open-end spinning machines having a variety of different separating and twisting devices with which the apparatus for creating effects may be utilized. In general, the apparatus according to the invention may be readily utilized with almost any conventional open-end spinning machine, and may be retrofit to most open-end spinning machines. The invention is utilizable with nearly all classes of open-end spinning machines including rotor systems, systems with axial aggregation of fibers, electrostatic systems, and vortex systems.

In FIGS. *7a* and *7b,* an elongated needle 34 is mounted for movement by a solenoid 35 into and out of transport tube 16 of a Platt Saco Lowell open-end spinning machine. This machine is generally similar to the SPIN-FLEX machine diagrammatically illustrated in FIG. 2 except that the yarn outlet tube 23 is not as elongated on the Platt, and the Platt is a downdraft machine. (In all of the open-end spinning machines described herein like reference numerals refer to like structures.)

Figure 8:
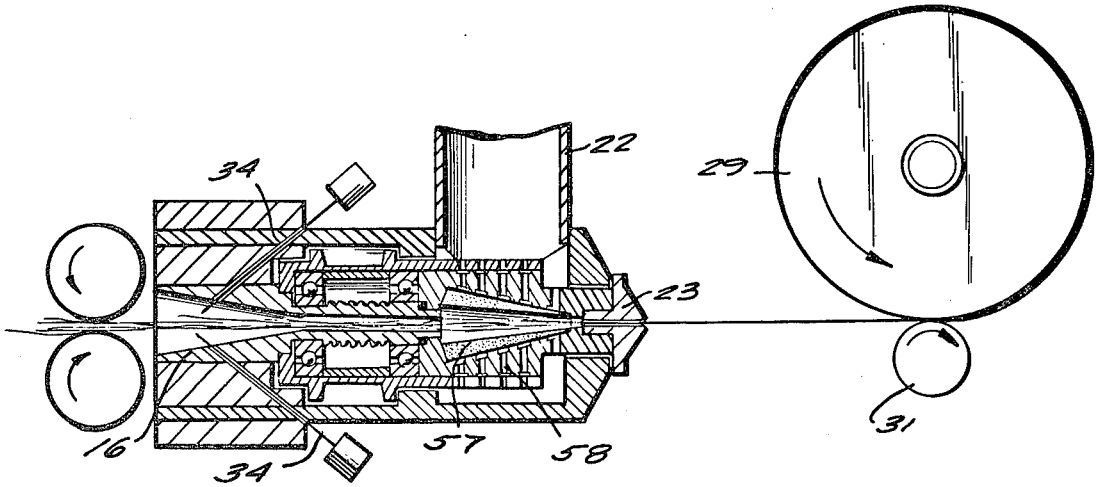

In FIG. 8, a plurality of needles 34 are illustrated in conjunction with the fiber transport tube 16 of a Sraitr-Bezstarosti open-end spinning machine. In this device, the rotor has a conical insert 57 of air-permeable material, with air from the rotor being sucked through the radial channels 58 connecting the rotor with the suction tube 22, the fibers accumulating on the conical surface of the permeable insert 57.

In FIG. 9, a single needle 34 is shown in operative association with the fiber transport tube 16 of a typical system with axial aggregation of fibers. The system illustrated in FIG. 9 is commonly called a Pavek open-end spinning device, and includes three sets of needles 59, 60, 61 mounted to counterweights 62 with a guiding needle 63 passing through the crests of the cones formed by the needles 59, 60, 61 and improving the parallelism of the fibers. A conventional combing roller 17 is provided as the fiber separating device.

FIG. 10 illustrates a needle 34 insertable and withdrawable by a solenoid 35 into and from the fiber transport tube 16 of a conventional DREF open-end spinning machine. The DREF spinning machine includes a conventional serated carding drum 70 as the fiber separating device, and the twisting device is formed by a pair of suction drums 71 each provided with a suction insert 72 which define confronting suction zones 73. The fibers F fall into the triangular region between the drums 71, with a pair of rolls 74 being provided at one end of the suction drums to serve and withdraw the resulting yarn and hold it against rotation at the same time.

FIG. 11 shows a needle 34 in operative association with a conventional air vortex open-end spinning system. In this system, the twisting device comprises a tube 80 extending generally perpendicular to the fiber transport tube 16 for the fibers F from the separating device (not shown). Suction is applied to one end 81 of the tube 80, air is introduced through ports 82 tangentially to the tube 80, and the yarn Y is withdrawn from the second end 83 of the tube 80, opposite the end 81.

Utilizing the apparatus according to the present invention heretofore described, a method of open-end spinning of a novelty yarn in an open-end spinning apparatus having a fiber separating device 12, twisting device 14, and fiber transport section 15 interconnecting the separating and twisting devices 12, 14 respectively may be practiced. The method comprises the steps of effecting controlled formation of effects (perferably slubs) in the fiber transport section 15 and passing those effects (preferably slubs) to the twisting device 14. The effect formation step is preferably accomplished by introducing a physical structure, such as a needle 34, 34'', 134, or 234 into the fiber transport section 15 to cause fiber collection thereon. When the needle 34, 34'', 134, or 234 is insertable into and withdrawable from the fiber flow in the fiber transport section 15, the passing step is accomplished by moving the needle out of functional contact with the fiber flow to release the effect (e.g. slub) S formed thereon. Preferably this insertion and withdrawal of the needle is random, being controlled by a Pugh pseudo-randomizer 40 or the like, although under some circumstances the control can be periodic if desired.

The method of open-end spinning of a novelty yarn Y from a sliver S' utilizing a fiber separating device 12 and a twisting device 14 consists essentially of the following steps: (a) The sliver S' is fed to the fiber separating device 12 to form distinct fibers F. (b) The fibers F are air transported in a fiber flow in a predetermined general path to the twisting device 14 (which path may be enclosed by a fiber transport tube 16). (c) Controlled formation of effects (preferably slubs) S is effected during air transport of the distinct fibers in the general flow path. This controlled formation is accomplished by inserting a physical structure, such as a needle 34, into the fiber flow path at an angle $\alpha$ of about 25°–45° with respect to the direction D of fiber flow. (d) Intermittently the formed effects (preferably slubs) S are passed to the twisting device 14. This is accomplished by withdrawing the elongated needle 34 from the fiber flow path, which causes release of the slub S formed thereon. (e) The fibers are then twisted by the twisting device 14, including any effects S passed thereto, into a continuous strand of novelty yarn Y, and (f) the novelty yarn Y is continuously taken up as a continuous strand by the withdrawal roll 25 and take-up roll 31, onto a package 29.

Utilizing the structure of FIG. *4c,* or FIGS. 14 through 16, a method of open-end spinning is accomplished by pivoting the elongated member 34'', 134, 234, so that the free end 90, 190, 290 thereof is in engagement, or substantial engagement, with a portion of the tubular member wall 16 opposite the pivot point to effect slub S formation. Then by pivoting the member 34'', 134, 234, free end 90, 190 290 out of engagement, or substantial engagement, with the wall, the slub S formed is released.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretion of the appended claims so as to encompass all equivalent methods and devices.

What is claimed is:

1. A method of open-end spinning a novelty yarn in an open-end spinning apparatus having a fiber separating device, a twisting device, an elongated thin member, and a fiber transport section interconnecting the separating and twisting devices, said method comprising the steps of: effecting controlled formation of effects in the fiber transport section by effecting controlled reciprocating introduction of the elongated member into the fiber flow within the transport section so that it at all times makes an angle of less than about 45° with respect to the direction of fiber flow; and intermittently passing those effects to the twisting device by reciprocally withdrawing the elongated member from the fiber flow so that it at all times makes an angle of less than about 45°.

2. A method a recited in claim 1 wherein said angle is about 25°–45°.

3. A method of open-end spinning a novelty yarn from a sliver utilizing a fiber separating device, and a twisting device, consisting essentially of the steps of (a) feeding the sliver to the fiber separating device, to form distinct fibers;

(b) air transporting the distinct fibers in a fiber flow in a predetermined general path to the twisting device;

(c) effecting controlled formation of effects from the distinct fibers during air transport of the distinct fibers in said general path by reciprocally introducing an elongated physical structure into the path of transport of fibers to cause fiber collection thereon, the structure at all times making an angle of about 25°–45° with respect to the path of fiber flow;

(d) intermittently passing the formed effects to the twisting device by reciprocally withdrawing the structure from the fiber flow path, the structure at all times making an angle of about 25°–45°;

(e) twisting the fibers fed to the twisting device, including any effects passed thereto, into a continuous strand of novelty yarn; and (f) taking up the novelty yarn continuous strand.

4. An open-end spinning device for spinning a slub yarn, and comprising: a fiber separating device; a twisting device; a fiber transport section disposed between said separating and twisting devices; at least one needle; means for mounting said at least one needle for insertion into and withdrawal from the fiber flow in said transport section at an angle of about 25°–45° with respect to the fiber flow in the transport section and so that said needle is spaced sufficiently from said twisting device that it cannot exert a holding back force upon any yarn end being produced by said twisting device, and so that said needle effects collection of fibers thereon when inserted into the fiber flow rather than merely causing reorientation of the fibers; and pseudo-random control means for pseudo-randomly controlling said means for effecting insertion and withdrawal of said needle.

5. Apparatus for spinning novelty yarn comprising an open-end spinning device including:

a fiber separating device;

a twisting device;

a fiber transport section disposed between said separating and twisting devices, said fiber transport section comprising a tubular member defined by a wall, and through which the fiber flows in a predetermined direction from the fiber separating device to the twisting device; and means for effecting controlled formation of effects in the transport section and for occasionally passing the formed effects to the twisting device, said means comprising: an elongated member having a length long enough to extend from one side of said tubular member wall to another portion of said tubular member wall; and means for pivotally mounting, for pivotal movement about an axis, said elongated member at a first side of said tubular member wall so that said elongated member has a free end extending angularly from said first side of said tubular member wall generally in the predetermined direction of fiber flow, and so that it is moveable from a collecting position wherein said free end thereof engages, or substantially engages, another side of said tubular member wall to collect effects between said free end and said wall, to a release position wherein said free end is spaced from said tubular member wall.

6. Apparatus as recited in claim 5 wherein said axis of pivotal movement is perpendicular to said predetermined direction of fiber flow.

7. Apparatus as recited in claim 6 further comprising means for oscillating said elongated member about its axis of pivotal movement so that said free end thereof moves from a first collecting position in engagement, or substantial engagement, with one portion of said tubular member wall, through a release position, to a second collecting position in engagement, or substantial engagement, with another portion of said tubular member wall.

8. Apparatus as recited in claim 5 wherein said axis of rotation and said predetermined direction of fiber flow are skew.

9. Apparatus as recited in claim 8 wherein the portion of said tubular member wall contacted by said elongated member free end in the collecting position thereof is opposite said first side of said tubular member wall.

10. Apparatus as recited in claim 9 wherein said elongated member has a short arm portion extending from said pivot mount to the exterior of said tubular member; and wherein said means for effecting controlled formation of effects further comprises solenoid means connected to said arm for effecting pivotal movement of said elongated member about said pivotal mount.

11. Apparatus as recited in claim 5 wherein said elongated member is curved outwardly from said first side of said tubular member wall.

12. Apparatus as recited in claim 5 wherein said tubular member is substantially conical, having decreasing diameter from said fiber separating device toward said twisting device.

13. A method of open-end spinning a novelty yarn from a sliver utilizing a fiber separating device, and a twisting device, consisting essentially of the steps of (a) feeding the sliver to the fiber separating device, to form distinct fibers;

(b) air transporting the distinct fibers in a fiber flow in a predetermined general path to the twisting device;

(c) effecting controlled formation of effects from the distinct fibers during air transport of the distinct fibers in said path by pivoting an elongated physical structure into a position wherein a free end thereof is in engagement, or substantial engagement, with a wall defining said general path;

(d) intermittently passing the formed effects to the twisting device by pivoting the elongated member to a release position wherein the free end thereof is spaced from the path-defining wall;

(e) twisting the fibers fed to the twisting device, including any effects passed thereto, into a continuous strand of novelty yarn; and (f) taking up the novelty yarn continuous strand.

14. A method as recited in claim 13 wherein steps (c) and (d) are practiced by pivoting the elongated member about an axis perpendicular to said path of fiber flow.

15. A method as recited in claim 13 wherein steps (c) and (d) are practiced by pivoting the elongated member about an axis that is skew relative to the path of fiber flow.

* * * * *